US011486077B2

(12) United States Patent
Li et al.

(10) Patent No.: US 11,486,077 B2
(45) Date of Patent: Nov. 1, 2022

(54) WASHING ADDITIVE AUTOMATIC DELIVERY DEVICE AND DRUM WASHING MACHINE

(71) Applicants: QINGDAO HAIER DRUM WASHING MACHINE CO., LTD., Shandong (CN); HAIER SMART HOME CO., LTD., Shandong (CN)

(72) Inventors: Wenwei Li, Shandong (CN); Benfu Xing, Shandong (CN); Xinhua Zhang, Shandong (CN); Rongshuai Cai, Shandong (CN); Zhiwei Zhao, Shandong (CN)

(73) Assignees: QINGDAO HAIER DRUM WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 134 days.

(21) Appl. No.: 16/978,351

(22) PCT Filed: Mar. 5, 2019

(86) PCT No.: PCT/CN2019/076974
§ 371 (c)(1),
(2) Date: Sep. 4, 2020

(87) PCT Pub. No.: WO2019/170076
PCT Pub. Date: Sep. 12, 2019

(65) Prior Publication Data

US 2022/0090310 A1 Mar. 24, 2022

(30) Foreign Application Priority Data

Mar. 5, 2018 (CN) ..... 201810179695.2
Mar. 5, 2018 (CN) ..... 201810179883.5
Mar. 5, 2018 (CN) ..... 201810180557.6

(51) Int. Cl.
*D06F 39/02* (2006.01)
*D06F 34/14* (2020.01)
(Continued)

(52) U.S. Cl.
CPC ..... *D06F 39/022* (2013.01); *D06F 34/14* (2020.02); *D06F 39/02* (2013.01); *D06F 39/14* (2013.01); *D06F 39/12* (2013.01); *D06F 2103/60* (2020.02)

(58) Field of Classification Search
CPC ..... D06F 39/022; D06F 39/12; D06F 39/14; D06F 34/14; D06F 2103/60
(Continued)

(56) References Cited

U.S. PATENT DOCUMENTS

2017/0233931 A1* 8/2017 Lee ..... D06F 39/022 68/17 R

FOREIGN PATENT DOCUMENTS

CN 104652098 A 5/2015
CN 205024472 U 2/2016
(Continued)

OTHER PUBLICATIONS

International Search Report (PCT/ISA/210), with translation, and Written Opinion (PCT/ISA/237) dated May 20, 2019, by the Japanese Patent Office as the International Searching Authority for International Application No. PCT/CN2019/076974.

*Primary Examiner* — Tisae B Ayalew
(74) *Attorney, Agent, or Firm* — Buchanan Ingersoll & Rooney PC

(57) ABSTRACT

The present disclosure discloses a washing additive automatic delivery device and a drum washing machine. The drum washing machine comprises a box, a container for accommodating washing additive and a mounting part for holding the container, wherein the box includes a mounting
(Continued)

base, the mounting part is arranged on the mounting base, and the container is arranged in the mounting part in a detachable manner. In the present disclosure, the mounting part is arranged on the mounting base, to save the upper space of a washing machine and increase the capacity of the container, moreover, the container is convenient for supplement of washing additive or the container can be taken out to supplement the washing additive.

8 Claims, 6 Drawing Sheets

(51) Int. Cl.
*D06F 39/14* (2006.01)
*D06F 39/12* (2006.01)
*D06F 103/60* (2020.01)

(58) Field of Classification Search
USPC ..... 68/12.18
See application file for complete search history.

(56) References Cited

FOREIGN PATENT DOCUMENTS

| | | | |
|---|---|---|---|
| CN | 106400403 | A | 2/2017 |
| CN | 107354677 | A | 11/2017 |
| CN | 208701369 | U | 4/2019 |

* cited by examiner

WASHING ADDITIVE AUTOMATIC DELIVERY DEVICE AND DRUM WASHING MACHINE

TECHNICAL FIELD

The present disclosure relates to the field of washing machines, in particular to a washing additive automatic delivery device and a drum washing machine.

BACKGROUND

Along with the development of science and technology, the automatic delivery technology of a washing machine is more and more applied in the working process of the washing machine. In the automatic delivery technology, the amount of detergent can be automatically and accurately determined according to the quantity of clothes, thereby avoiding to a great extent inaccurate amount of delivered detergent when detergent is delivered artificially. On the other hand, through the detergent automatic delivery technology, a larger amount of detergent is delivered at one time, and the detergent can be used for a long time after being delivered once, thereby greatly saving the time cost in detergent delivery during each clothes washing. However, since the delivery technology is automatic, when less detergent remains or especially when the washing additive is not sufficient for one delivery, the problem of insufficient delivered amount exists, therefore, the amount of the washing additive needs to be detected, such that when the liquid level is not sufficient, timely alarming can be made to prompt the user to add the washing additive.

In some existing washing machines which deliver detergent automatically, a liquid outlet of a box body is configured to supply detergent and a liquid level detection mechanism is configured to detect the liquid level of the detergent and send a prompt are relatively independent structures. Through such a structure, the structure of a detergent storage device is relatively complex, and the manufacturing cost is greatly increased. Due to the space limitation of a washing machine itself, if the structure of the detergent storage device is complex, the space inside a washing machine is occupied, and even the capacity of the detergent box itself is influenced. The existing liquid level detection structure mostly adopts a dry reed type liquid level detection mechanism. The Chinese patent with an application number of 201310265486.7 discloses a detergent supply device and a washing machine provided with the detergent supply device, wherein the liquid level detection mechanism is arranged at a liquid outlet, and includes: a sliding rod arranged along a vertical direction, wherein the sliding rod is connected with the liquid outlet cover and extends into the box body, the sliding rod is internally provided with two iron sheets which are arranged at intervals and which extend along an axial direction of the sliding rod; a magnetic floating ring, wherein the magnetic floating ring is sleeved on the sliding rod and can move up and down along the axial direction of the sliding rod, to conduct the two iron sheets when the magnetic floating ring moves to a preset position; and a controller which is respectively connected with the two iron sheets through a wire. In the present disclosure, although the liquid level at the liquid outlet can be measured, however, since a liquid level detection mechanism is arranged at the liquid outlet, the structure of the liquid outlet is complex, the dry reed type liquid level detection mechanism is complex originally, such that the structure at the liquid outlet is more complex, the assembly is complex, professionals are required, and the cost is increased, meanwhile, the liquid level precision is not high, the detection at a low liquid level is not sensitive enough, false alarm or delayed alarm easily occurs, thereby bringing great inconvenience for the customers.

In addition, the existing washing additive containers are mostly non-removable structures, when the liquid level is low, the washing additive container cannot be taken out to supplement liquid. Even if some washing additive containers can be taken out, such washing additive containers are complex in structure, and are difficult to operate by ordinary users.

Moreover, the washing additive containers of the existing drum washing machines are mostly installed on the top part or the upper left part and other obvious positions of the washing machine, and occupy a lot of positions of the top part or the upper left part of the washing machine. Since the upper space of the drum washing machine is narrow, the washing additive containers of these washing machines are generally long-strip-shaped, and extend along a vertical direction of the washing machine, thereby making it difficult for users to look over the amount of detergent left in the storage box, and being not beneficial for the users to timely add washing additive. In addition, for a double drum washing machine, when the washing additive container is arranged on the top of the washing machine, a long delivery pipeline for communicating the lower washing drum is required, thereby bringing about more inconveniences.

In view of this, the present disclosure is hereby proposed.

SUMMARY

The technical problem to be solved in the present disclosure is to overcome shortcomings of the prior art, and provide a washing additive automatic delivery device and a drum washing machine.

A first object of the present disclosure is to provide a washing additive automatic delivery device.

In order to solve the above technical problem, a basic conception of the technical solution adopted in the present disclosure is as follows: a washing additive automatic delivery device includes a container for accommodating washing additive and a mounting part for holding the container, wherein the container is arranged in the mounting part in a removable manner, and the device further includes at least one group of liquid level detection structures configured to detect liquid level in the container.

Further, the liquid level detection structure includes a detection part, and a conducting part connected with the circuit, wherein one end of the detection part is inserted into the container in a sealed manner, and the other end is in contact with the conducting part to conduct the circuit when the container is placed in the mounting part, and is separated from the conducting part to disconnect the circuit when the container is taken out from the mounting part.

Further, the liquid level detection structures include two detection parts and two conducting parts, wherein when the detection parts are respectively in contact with corresponding conducting parts, the washing additive in the container is in contact with both two detection parts, then the two detection parts are conducted through the washing additive, the liquid level detection structure forms a circuit pathway, and the detection part detects that sufficient washing additive is available; otherwise, if the washing additive in the container is not in contact with at least one detection part, the circuit between the two detection parts is disconnected, then when the liquid level is low, washing additive needs to be supplemented.

Further, the liquid level detection structure further includes a fixed part, the detection part is wrapped in the fixed part in a sealed manner, the two ends are both arranged to extend out of the fixed part, one end of the detection part is inserted into the container in a detachable and sealed manner through the fixed part, preferably, the fixed part is connected with the container through threads.

Further, one end of the detection part is inserted into the container in a detachable and sealed manner from the bottom of the container through a fixed part, the fixed part is manufactured from insulating materials, at least part of the fixed part is inserted into the container, and the height from the top end of the inserting part to the bottom of the container is a measurable lowest liquid level.

Further, the liquid level detection structure further includes a sealing structure for sealing the fixed part and the container, and the sealing structure is arranged between the container and the fixed part, preferably, the sealing part is a sealing ring.

Further, the fixed part includes a sealing protruding part which is arranged to protrude out of the side wall, and the sealing structure is arranged between the bottom of the container and the sealing protruding part.

Further, the detection part is a conducting probe; and the conducting part is a shrapnel structure communicated with a wiring terminal through a signal line, and the other end of the detection part is connected with the shrapnel structure in a pluggable manner.

Further, the container includes at least one liquid storage chamber configured to accommodate the washing additive, each liquid storage chamber includes at least one group of liquid level detection structures, preferably, the liquid level detection structure includes a detection part and a conducting part connected with the circuit, one end of the detection part is inserted into the liquid storage chamber in a sealed manner, and the other end is in contact with the conducting part to conduct the circuit when the container is placed in the mounting part, and is separated from the conducting part to disconnect the circuit when the container is taken out from the mounting part, more preferably, one end of the detection part is inserted into the liquid storage chamber in a detachable and sealed manner from the bottom of the container.

A second object of the present disclosure is to provide a drum washing machine, including the above-mentioned washing additive automatic delivery device.

A third object of the present disclosure is to provide a drum washing machine, including:

a front panel, wherein the front panel includes a clothes delivery opening which accommodates a machine door; and a container configured to accommodate washing additive, wherein the container is arranged in the clothes delivery opening of the front panel.

Further, the clothes delivery opening is internally provided with a mounting hole, and the container is detachably arranged in the mounting hole.

Further, the drum washing machine further includes a protective cover for protecting the container, and the protective cover is arranged at the mounting hole.

Further, the shape of the protective cover is matched with the shape of the mounting hole, and the shape of the container is matched with the shape of the mounting hole.

Further, one end of the protective cover is hinged with the mounting hole, and the other end can be turned over movably around the hinged end to open or close the mounting hole.

Further, the protective cover is provided with an uncovering part which is convenient to open the protective cover.

Further, the mounting hole is arranged at the bottom of the clothes delivery opening, and the protective cover is arranged above the mounting hole.

Further, the container is a box-shaped structure with at least the upper surface being a rectangle, the surface, for setting the mounting hole, of the clothes delivery opening is a plane, and the upper surface of the protective cover is lower than or in parallel with the plane.

Further, the uncovering part is a notch arranged on the protective cover and convenient for being pulled by hands, preferably, the notch is a notch arranged on another movable end of the protective cover.

Further, the mounting hole includes a limit part for limiting the mounting of the container.

A fourth object of the present disclosure is to provide a drum washing machine. The drum washing machine includes a box, a container for accommodating washing additive, and a mounting part for holding the container, wherein the box includes a mounting base, the mounting part is arranged on the mounting base, and the container is arranged in the mounting part in a detachable manner.

Further, the washing machine further includes a front panel, the mounting base is arranged behind the front panel, and the mounting part is arranged on the mounting base behind the front panel in a detachable manner.

Further, the front panel includes a clothes delivery opening for accommodating a machine door, and the container is arranged in the mounting part in a detachable manner through a clothes delivery opening.

Further, the mounting base includes a mounting beam arranged behind the front panel, preferably, the mounting beam is arranged on the box frame.

Further, the mounting part includes a connecting part, and the mounting part is connected on the mounting beam in a detachable manner through a connecting part.

Further, the connecting part includes a connecting boss which is arranged to protrude out of the mounting part, the mounting part is connected with the mounting beam through a connecting boss, preferably, the connecting boss includes a screw hole, and the mounting part is connected with the mounting beam through a screw.

Further, the connecting part includes a connecting hook which is set to protrude out of the mounting part, and the mounting part is attached to the mounting beam through a connecting hook.

Further, the clothes delivery opening is internally provided with a mounting hole, and the container is arranged in the mounting part in a detachable manner through a mounting hole.

Further, the container includes a liquid supplement opening for supplementing washing additive, preferably, the liquid supplement opening is arranged at the mounting hole, more preferably, the drum washing machine further includes a protective cover for protecting the container, and the protective cover is arranged at the mounting hole; and a liquid outlet for delivering washing additive, wherein the liquid outlet is provided with a liquid outlet valve, the liquid outlet valve controls the liquid outlet to open when the container is installed in the mounting part, and controls the liquid outlet to close in a sealed manner when the container is taken out from the mounting part, preferably, the liquid outlet valve is a one-way valve.

Further, the container further includes a taking-out part which is convenient for taking out/installation from the mounting part, preferably, the taking-out part is a concave part arranged on the container and convenient for being pulled by hands.

After the above technical solution is adopted, the present disclosure has the following beneficial effects compared with the prior art.

In the present disclosure, the container is arranged in the mounting part in a removable manner, to supplement the washing additive; the liquid level detection structure of the present disclosure can be configured to detect the liquid level of the container which is removably arranged in the mounting part, after the container is taken out to supplement washing additive, after the container is placed, the liquid level can be detected continuously sensitively and accurately; the detection part of the liquid level detection structure of the present disclosure is inserted into the container from the bottom of the container, to more conveniently detect whether the washing additive in the container is sufficient; meanwhile, since the liquid outlet is also arranged at the bottom, therefore, the arrangement at the bottom is convenient for mounting, no other structures are added, and the cost is saved; compared with the liquid level detection structure with a floater, the liquid level detection structure of the present disclosure is more sensitive and accurate in detection results, the structure is simple and easily molded, and the reliability is high.

In the present disclosure, the container is arranged in the clothes delivery opening of the front panel, therefore, the upper space of the washing machine is saved, and the capacity of the container is enlarged, moreover, the container is convenient for supplement of washing additive or the container can be taken out to supplement the washing additive; and the container is arranged in the mounting part through the clothes delivery opening, when the machine door is closed, the container is hidden, when the machine door is open, the container can be taken out to supplement the washing additive or the washing additive can be supplemented directly, therefore, the integrity and beauty of the washing machine are ensured, users can operate conveniently, and the structure is simple.

In the present disclosure, the mounting part is arranged on the mounting base, therefore, after the mounting base is arranged behind the front panel, the upper space of the washing machine is saved, and the capacity of the container is enlarged. Moreover, the container is convenient for supplement of washing additive or the container is taken out to supplement the washing additive; and the container is arranged in the mounting part through the clothes delivery opening, when the machine door is closed, the container is hidden, when the machine door is open, the container can be taken out to supplement the washing additive or the washing additive can be supplemented directly. Therefore, the integrity and beauty of the washing machine are ensured, users can operate conveniently, and the structure is simple; and when the mounting beam in the present disclosure is arranged on a box frame, a function of enhancing the strength of the box of the washing machine is further possessed.

A further detailed description will be given below on specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings.

Figure 1:
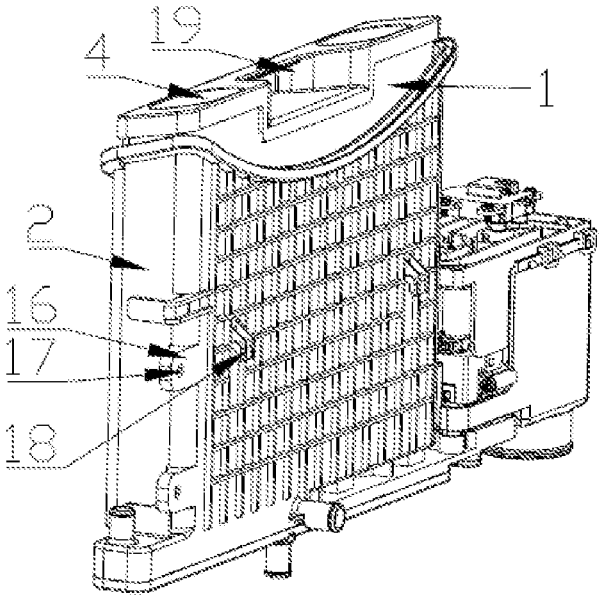
FIG. 1 is a schematic diagram of installation of a container of the present disclosure.

Reference numerals in the figures: 1, container; 2, mounting part; 3, front panel; 4, liquid supplement opening; 5, liquid outlet opening; 6, detection part; 7, conducting part; 8, wiring terminal; 9, fixed part; 10, sealing structure; 11, sealing protruding part; 12, clothes delivery opening; 13, protective cover; 14, uncapping part; 15, mounting beam; 16, connecting boss; 17, screw hole; 18, connecting hook; 19, taking-out part.

It should be noted that, these drawings and text descriptions are not aiming at limiting a conception range of the present disclosure in any form, but to describe concepts of the present disclosure for those skilled in the art with reference to specific embodiments.

DETAILED DESCRIPTION OF THE EMBODIMENTS

In order to make the object, technical solutions and advantages of the embodiments in the present disclosure clearer, a clear and complete description will be given below on technical solutions in the embodiments in combination with accompanying drawings in the embodiments of the present disclosure. The following embodiments are used for describing the present disclosure, rather than for limiting the scope of the present disclosure.

In the description of the present disclosure, it should be noted that, the orientation or positional relationship indicated by such terms as "up", "down", "inner" and "outer" is the orientation or positional relationship based on the accompanying drawings. Such terms are merely for the convenience of description of the present disclosure and simplified description, rather than indicating or implying that the device or element referred to must be located in a certain orientation or must be constructed or operated in a certain orientation, therefore, the terms cannot be understood as a limitation to the present disclosure.

In the description of the present disclosure, it should be noted that, unless otherwise stipulated and defined definitely, such terms as "installed" and "connected" should be understood in their broad sense, e.g., the connection can be a fixed connection, a detachable connection or an integral connection; can be mechanical connection or electrical connection; and can be direct connection or can be indirect connection through an intermediate. For those skilled in the art, the specific meanings of the above terms in the present disclosure can be understood according to specific conditions.

A further introduction will be given below on specific embodiments of the present disclosure in combination with accompanying drawings.

Embodiment 1

Figure 2:
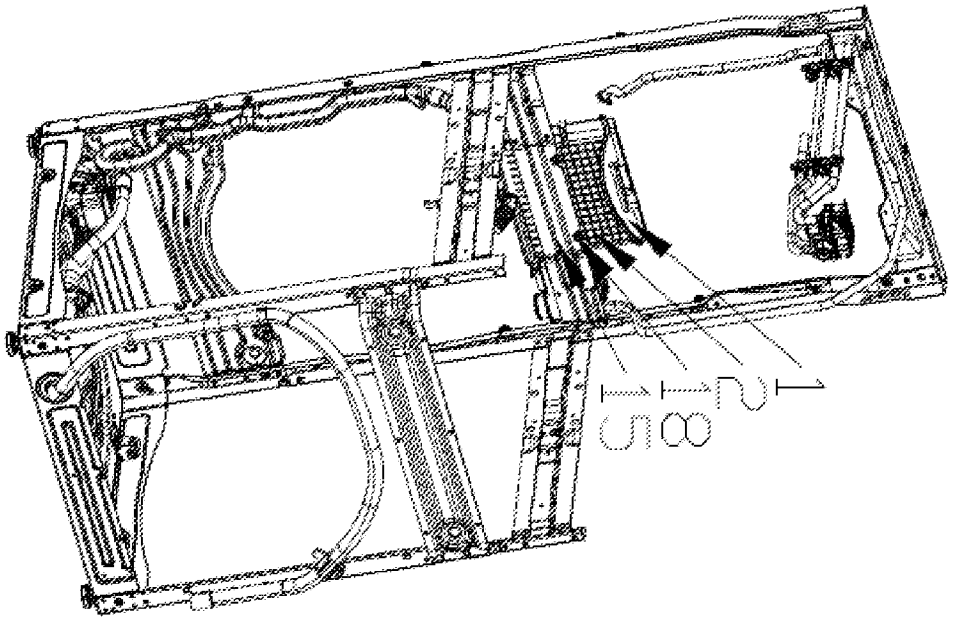
FIG. 2 is a schematic diagram of installation of a mounting part of the present disclosure.
Figure 3:
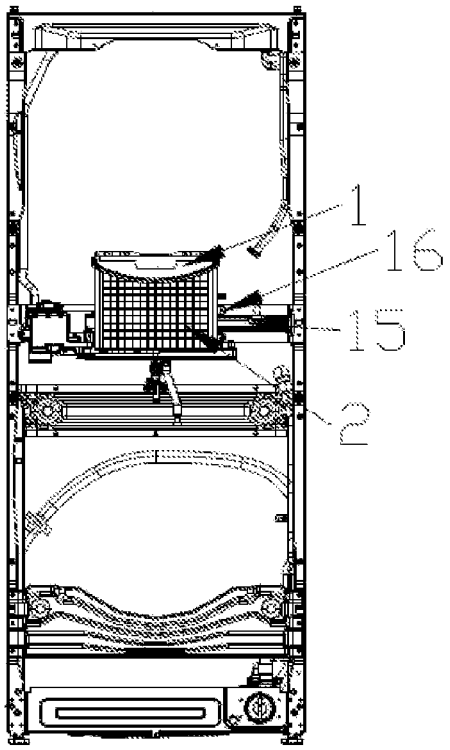
FIG. 3 is front view of installation of a mounting part of the present disclosure.

As shown in FIGS. 1-3, a drum washing machine includes a box, a container 1 for accommodating washing additive, and a mounting part 2 for holding the container 1, the box includes a mounting base, the mounting part 2 is arranged on the mounting base, and the container 1 is arranged in the mounting part 2 in a detachable manner.

In the above solution, the drum washing machine includes a box, the containers 1 of the existing drum washing machines are mostly installed on the top part or the upper left part and other obvious positions of the washing machine, and occupy a large space of the top part or upper left part of the washing machine. And since the upper space of the drum washing machine is narrow, the containers 1 of these washing machines are generally long-strip-shaped, and extend along a vertical direction of the washing machine, thereby making it difficult for users to look over the amount of detergent left in the storage box, and being not beneficial for the users to timely add washing additive. Also due to uneasy taking out and placing of the container 1 caused by long and narrow structure and complex wiring, users find it very inconvenient to add washing additive. In the present disclosure, the container 1 is arranged in the mounting part 2 in a detachable manner, the mounting part 2 is arranged on the mounting base, thereby saving the upper space of the washing machine, and also increasing the size of the container 1, a long and narrow structure is no longer adopted, thereby facilitating supplement of washing additive in the container 1 or taking out of the container 1 to supplement liquid. In addition, in one embodiment, the drum washing machine is a double-drum washing machine, that is, a double-drum washing machine including an upper and a lower drum, since the double-drum washing machine needs to accommodate two drums, the box is large, and the container 1 is arranged on the top part or the upper left part of the washing machine. When washing additive needs to be added to the lower drum, a long pipeline is required or an extra container 1 is needed, thereby increasing the complexity of the container 1 and the difficulty in delivering washing additive, and easily leading to such problems as pipeline clogging or damage. In the present disclosure, the box includes a mounting base, the container 1 is arranged on the mounting base through a mounting part 2, thereby saving the space of the top part of the washing machine, meanwhile, the container 1 can also be arranged at the position close to both of the two washing drums, and the mounting base can be arranged at the position close to both of the two washing drums.

Further, the washing machine further includes a front panel 3, the mounting base is arranged behind the front panel 3, and the mounting part 2 is arranged on the mounting base behind the front panel 3 in a detachable manner.

In the above solution, the mounting base is arranged behind the front panel 3, to save the upper space of the washing machine, and also increase the size of the container 1, a long and narrow structure is no longer adopted, thereby facilitating supplementing the washing additive in the container 1 or taking out the container 1 to supplement the washing additive. The installation of the mounting part 2 is firmer and more convenient.

Further, the front panel 3 includes a clothes delivery opening 12 for accommodating the machine door, and the container 1 is arranged in the mounting part 2 in a detachable manner through a clothes delivery opening 12.

In the above solution, the container 1 is arranged in the mounting part 2 in a detachable manner through a clothes delivery opening 12, such that the taking out and mounting of the container 1 are more convenient, meanwhile, even if the container 1 is not taken out, the washing additive can also be conveniently supplemented at the clothes delivery opening 12. The mounting part 2 is arranged behind the front panel 3, the container 1 can only be taken out from the clothes delivery opening 12 when the machine door of the washing machine is open, when the machine door of the washing machine is closed, the container 1 is not seen from the outside, such that the drum washing machine has a better integrity and is more nice-looking and elegant. The container 1 can be drawn, taken out and placed towards the left and right direction, or can be drawn, taken out and placed towards the up and down direction from the circumferential wall of the clothes delivery opening 12. In the present embodiment, when the drum washing machine is a double-drum washing machine, a preferred embodiment is that the container 1 is set at the clothes delivery opening 12 of the upper drum, and when the container 1 is set at the clothes delivery opening 12 of the upper drum, the container 1 is not far away from the two washing drums, and the washing additive can be delivered with no need of a long pipeline, thereby simplifying the container 1, saving space, saving materials, lowering the cost, and ensuring that the pipeline is not easily blogged or damaged.

Further, the mounting base includes a mounting beam 15 arranged behind the front panel 3, preferably, the mounting beam 15 is arranged on the box frame.

In the above solution, the mounting base includes a mounting beam 15 arranged behind the front panel 3, the mounting beam 15 does not occupy extra space inside the washing machine, so as to save the space inside the washing machine, increase the volume of the container, and connect and fix the mounting part 2, and the container 1 is arranged behind the front panel 3, thereby being hidden and good-looking. The mounting beam 15 is arranged on the box frame, thereby playing a role of enhancing the strength of the box/box frame. In one implementing manner of the present embodiment, the drum washing machine is a double-drum washing machine, that is, a double-drum washing machine including an upper and a lower drum. Since the double-drum washing machine needs to accommodate two drums, the box is large, then the requirement on the strength of the box is high, in the present embodiment, when the mounting beam is arranged on the box frame, on the one hand, the strength of the box/box frame is enhanced, on the other hand, when the mounting part 2 is arranged on the mounting beam, the occupied space is small, the mounting part 2 and the box are mounted separately, when the box is detached for maintenance, the problem of influencing the mounting part 2 does not need to be considered. Since the mounting part 2 is connected with each pipeline, if the mounting part 2 is detached for maintenance together with the box, the troublesome in detachment and maintenance will be greatly increased.

Further, the mounting part 2 includes a connecting part, and the mounting part 2 is connected to the mounting beam 15 in a detachable manner through a connecting part.

In the above solution, the connecting part is configured to mount the mounting part 2 on the mounting beam 15 in a detachable manner, through the detachable connection, the mounting part 2 can be maintained and detected conveniently.

Further, the connecting part includes a connecting boss 16 arranged to protrude out of the mounting part 2, the mounting part 2 is connected with the mounting beam 15 through a connecting boss 16, preferably, the connecting boss 16 includes a screw hole 17, and the mounting part 2 is connected with the mounting beam 15 through screws.

Further, the connecting part further includes a connecting hook 18 arranged to protrude out of the mounting part 2, the mounting part 2 is hanged on the mounting beam 15 through the connecting hook 18, preferably, the mounting beam 15 is a mounting cross beam, and the mounting part is hanged on the mounting cross beam through the connecting hook 18.

In the above solution, the connecting part can only include the connecting boss 16, or only include the connecting hook 18, however, since the mounting part 2 is arranged in the washing machine, the mounting part 2 will shake inevitably, therefore, if only a connecting hook 18 is included, the mounting part 2 will inevitably move, and the mounting part 2 cannot be fixed, if only a connecting boss 16 is included, the pressure on the connecting boss 16 is large, and the connecting boss 16 is easily damaged. In the present embodiment, not only a connecting boss 16 is included for connection, but also a connecting hook 18 is included for connection, such that the mounting stability of the mounting part 2 is strong.

Further, the clothes delivery opening 12 is internally provided with a mounting hole, and the container 1 is arranged in the mounting part 2 in a detachable manner through the mounting hole.

Further, the bottom wall of the clothes delivery opening 12 is provided with a mounting hole, the mounting part 2 is arranged below the mounting hole, and the container 1 is drawn to be taken out from the mounting hole or placed downwards in the mounting part 2.

In the above solution, since the space at the right and left sides of the clothes delivery opening 12 of the front panel 3 of the drum washing machine is small, under general conditions, the container 1 and the mounting part 2 are arranged at the upper and lower sides of the clothes delivery opening 12 of the front panel 3. Also since the upper side proposes a high requirement on sealing and delivery of washing additive, preferably, the container 1 and the mounting part 2 are arranged below the clothes delivery opening 12. In the double-drum washing machine, the container 1 and the mounting part 2 are arranged at the lower side of the clothes delivery opening 12 of the upper drum, thereby facilitating delivery of the washing additive to the two washing drums by the container 1.

Further, the container 1 includes: a liquid supplementing opening 4 for supplementing washing additive, preferably, the liquid supplementing opening 4 is arranged at the mounting hole, more preferably, the drum washing machine further includes a protective cover 13 for protecting the container 1, the protective cover 13 is arranged at the mounting hole. A liquid outlet 5 for delivering washing additive, wherein the liquid outlet 5 is provided with a liquid outlet valve, the liquid outlet valve controls the liquid outlet 5 to open when the container 1 is mounted in the mounting part 2, and the liquid outlet valve controls the liquid outlet 5 to be sealed and closed when the container 1 is taken out from the mounting part 2, preferably, the liquid outlet valve is a one-way valve.

Further, the container 1 includes at least one liquid storage chamber for accommodating the washing additive, and each liquid storage chamber includes a liquid supplementing opening 4 and a liquid outlet 5.

In the above solution, when the liquid supplementing opening 4 is arranged at the mounting hole, the washing additive can be conveniently supplemented by the user when the container 1 is not taken out or the container 1 cannot be taken out, no parts need to be detached, and the washing additive can be supplemented by only opening the machine door. A liquid outlet valve is arranged, such that the washing additive can be delivered normally after the container 1 is mounted, and when the container 1 is taken out to supplement the washing additive, washing additive will not leak from the liquid outlet 5. The protective cover 13 is provided with an uncovering part 14 which is convenient to open the protective cover 13. The protective cover 13 is arranged to protect the container 1, thereby preventing dust or liquid from entering the container 1 to pollute the washing additive, and also having a sealing effect of preventing leakage of the container 1. Especially when the liquid supplementing opening 4 is arranged at the mounting hole, the protective cover 13 covers the liquid supplementing opening 4 for protection.

Further, the container 1 further includes a taking-out part 19 facilitating taking out from or mounting in the mounting part 2, preferably, the taking-out part 19 is a concave part which is arranged on the container 1 to facilitate hand pulling.

Embodiment 2

Figure 4:
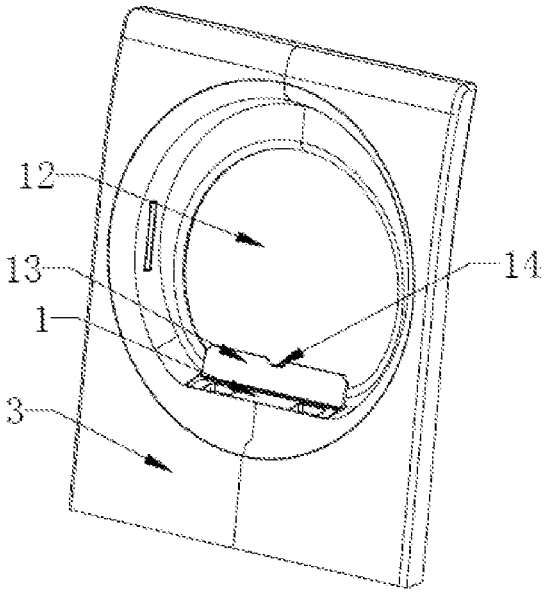
FIG. 4 is a first schematic diagram of a front panel (provided with no machine door) of a drum washing machine of the present disclosure.
Figure 5:
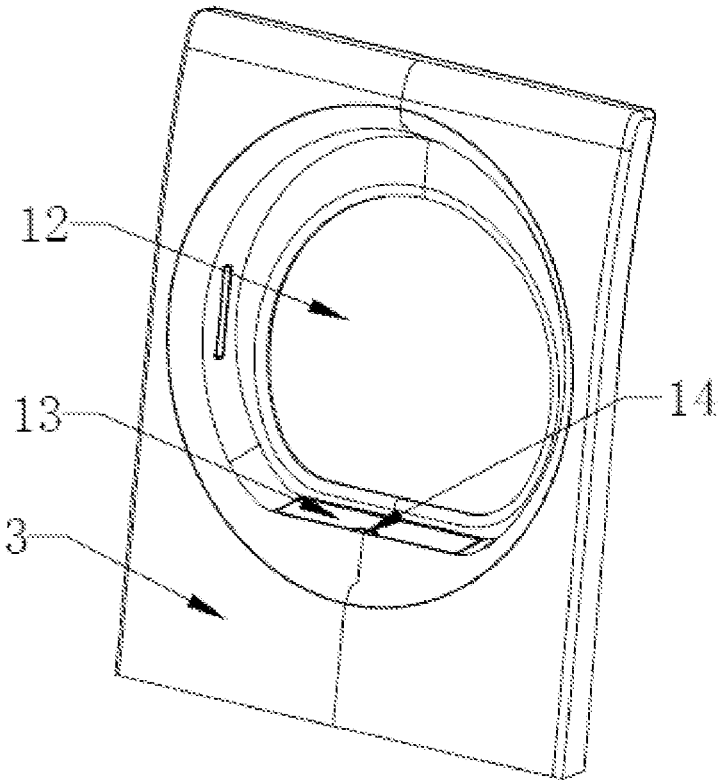
FIG. 5 is a second schematic diagram of a front panel (provided with no machine door) of a drum washing machine of the present disclosure.
Figure 6:
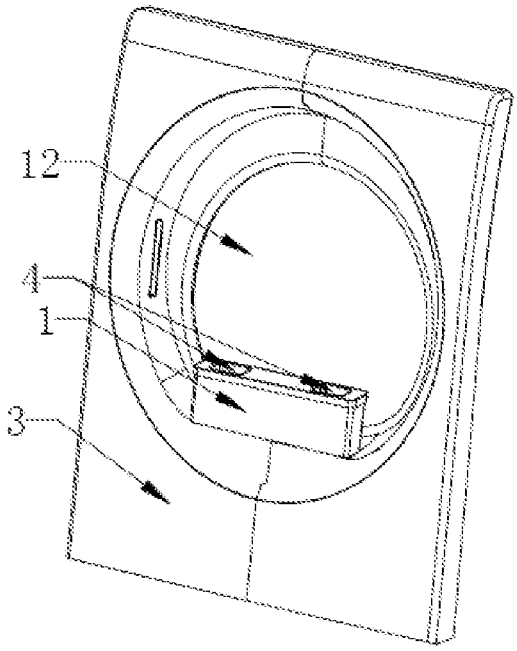
FIG. 6 is a third schematic diagram of a front panel (provided with no machine door) of a drum washing machine of the present disclosure.

As shown in FIG. 4 to FIG. 6, a drum washing machine includes a front panel 3, a container 1 for accommodating the washing additive and a mounting part 2 for holding the container 1, wherein the mounting part 2 is arranged on the front panel 3, and the container 1 can be arranged in the mounting part 2 in a detachable manner.

In the above solution, the containers 1 of the existing drum washing machines are mostly mounted at the top part or the upper left part and other obvious positions of the washing machine, and occupy a lot of positions of the top part or upper left part of the washing machine, also since the upper space of the drum washing machine is narrow, the containers 1 of these washing machines are generally long-strip-shaped, and extend along a vertical direction of the washing machine, thereby making it difficult for users to look over the amount of detergent left in the storage box, and being not beneficial for the users to timely add washing additive. Also due to uneasy taking out and placing of the container 1 due to long and narrow structure and complex line, users find it very inconvenient to add the washing additive. In the present disclosure, the container 1 is arranged in the mounting part in a detachable manner, and the mounting part 2 is arranged on the front panel 3, thereby saving the upper space of the washing machine, and simultaneously increasing the size of the container 1, and a long and narrow structure is no longer adopted, thereby facilitating supplement of the washing additive in the container 1 or taking out of the container 1 for supplementing liquid.

Further, the front panel includes a clothes delivery opening 12 for accommodating the machine door, the container 1 is arranged in the mounting part 2 in a detachable manner through the clothes delivery opening 12, preferably, the mounting part 2 is arranged on the rear wall of the front panel 3.

In the above solution, the container 1 is arranged in the mounting part 2 in a detachable manner through the clothes delivery opening 12, such that the taking out and mounting of the container 1 are more convenient, meanwhile, even if the container 1 is not taken out, the washing additive can also be supplemented conveniently at the clothes delivery opening. The mounting part 2 is arranged on the rear wall of the front panel 3, when the machine door of the washing machine is open, the container 1 can be taken out from the clothes delivery opening 12, when the machine door of the washing machine is closed, the container is not seen from the outside, such that the drum washing machine has a better integrity and is more nice-looking and elegant. The container 1 can be drawn, taken out and placed towards the left and right direction, or can be drawn, taken out and placed towards the up and down direction from the circumferential wall of the clothes delivery opening 12.

Further, the clothes delivery opening 12 is internally provided with a mounting hole, and the container 1 is arranged in the mounting part 2 in a detachable manner through the mounting hole.

Further, the bottom wall of the clothes delivery opening 12 is provided with a mounting hole, the mounting part 2 is arranged below the mounting hole, and the container 1 is drawn to be taken out from the mounting hole or placed downwards in the mounting part 2.

In the above solution, since the space at the right and left sides of the clothes delivery opening 12 of the front panel 3 of the drum washing machine is small, under general conditions, the container 1 and the mounting part 2 are arranged at the upper and lower sides of the clothes delivery opening 12 of the front panel, also since the upper side proposes a high requirement on sealing and delivery of washing additive, preferably, the container 1 and the mounting part 2 are arranged below the clothes delivery opening 12.

Further, the container 1 includes: a liquid supplementing opening 4 for supplementing washing additive, preferably, the liquid supplementing opening 4 is arranged at the mounting hole; and a liquid outlet 5 for delivering washing additive. Wherein the liquid outlet 5 is provided with a liquid outlet valve, the liquid outlet valve controls the liquid outlet 5 to open when the container 1 is mounted in the mounting part 2, and the liquid outlet valve controls the liquid outlet 5 to be sealed and closed when the container 1 is taken out from the mounting part 2, preferably, the liquid outlet valve is a one-way valve.

Further, the container 1 includes at least one liquid storage chamber for accommodating the washing additive, and each liquid storage chamber includes a liquid supplementing opening 4 and a liquid outlet 5.

In the above solution, when the liquid supplementing opening 4 is arranged at the mounting hole, the washing additive can be conveniently supplemented by the user when the container 1 is not taken out or the container 1 cannot be taken out, no parts need to be detached, and the washing additive can be supplemented by only opening the machine door. A liquid outlet valve is arranged, such that the washing additive can be delivered normally after the container 1 is mounted, and when the container 1 is taken out to supplement the washing additive, washing additive will not leak from the liquid outlet.

Further, the drum washing machine further includes a delivery part, wherein the delivery part is respectively communicated with the washing drum and the liquid outlet 5, to deliver the washing additive in the container 1 into the washing drum.

In the above solution, the delivery part is a negative-pressure automatic delivery structure, or the delivery part is a suction-pump delivery structure, or the delivery part includes a siphon structure.

Further, the drum washing machine further includes a liquid level detection structure, and the liquid level detection structure includes: a conducting part 7 connected with the circuit, wherein the conducting part 7 is arranged in the mounting part 2; a detection part 6, wherein one end of the detection part 6 is inserted into the liquid storage chamber of the container 1 in a sealed manner, the other end is in contact with the conducting part 7 when the container 1 is arranged in the mounting part 2, to conduct the circuit to detect the liquid level, and the other end is separated from the conducting part 7 when the container 1 is taken out from the mounting part 2, to disconnect the circuit.

Further, the detection part 6 is a conducting probe; the conducting part 7 is a shrapnel structure communicated with a wiring terminal through a signal line, and the other end of the detection part 6 is connected with the shrapnel structure in a pluggable manner.

Further, the drum washing machine further includes a protective cover 13 for protecting the container 1, and the protective cover 13 is arranged at the mounting hole, preferably, when the protective cover 13 is closed, the protective cover 13 at least covers the liquid supplement opening 4.

Further, the protective cover 13 is provided with an uncovering part 14 which is convenient to open the protective cover 13.

In the above solution, the protective cover 13 is arranged to protect the container 1, thereby preventing dust or liquid from entering the container 1 to pollute the washing additive, and also having a sealing effect of preventing leakage of the container 1. Especially when the liquid supplementing opening 4 is arranged at the mounting hole, the protective cover 13 covers the liquid supplementing opening 4 for protection.

Further, the mounting hole further includes a limit structure for limiting the mounting of the container 1, preferably, the limit structure is a protruding part which is arranged to protrude out of the side wall of the container 1.

In the above solution, a limit structure is arranged to enable the detachment or taking out or placing of the container 1 to be simpler and more convenient, such problems as misplacement will not exist, thereby avoiding incapability in normal automatic delivery of the washing additive or incapability in normal detection of liquid level caused by such problems as misplacement.

Embodiment 3

As shown in FIG. 4 to FIG. 6, in the present embodiment, a drum washing machine includes a front panel 3, the front panel 3 includes a clothes delivery opening 12 for accommodating the machine door, and a container 1 for accommodating the washing additive, wherein the container 1 is arranged in the clothes delivery opening 12 of the front panel.

In the above solution, the containers 1 of the existing drum washing machines are mostly mounted at the top part or the upper left part and other obvious positions of the washing machine, and occupy a lot of positions of the top part or upper left part of the washing machine, also since the upper space of the drum washing machine is narrow, the containers 1 of these washing machines are generally long-strip-shaped, and extend along a vertical direction of the washing machine, thereby making it difficult for users to look over the amount of detergent left in the storage box, and being not beneficial for the users to timely add washing additive. Also due to uneasy taking out and placing of the container 1 due to long and narrow structure and complex line, users find it very inconvenient to add the washing additive. In the present disclosure, the container 1 is arranged in the clothes delivery opening 12 of the front panel 3, thereby saving the upper space of the washing machine, and simultaneously increasing the size of the container 1, and a long and narrow structure is no longer adopted, thereby facilitating supplement of the washing additive in the container 1 or taking out of the container 1 for supplementing liquid. In addition, when the machine door of the washing machine is open, the container 1 can be taken out from the clothes delivery opening 12, when the machine door of the washing machine is closed, the user cannot see the container form the outside, such that the drum washing machine has a better integrity and is more nice-looking and elegant. The container 1 can be drawn, taken out and placed towards the left and right direction or can be drawn, taken out and placed towards the up and down direction from the circumferential wall of the clothes delivery opening 12.

Further, the clothes delivery opening 12 is internally provided with a mounting hole, and the container 1 is arranged in the mounting hole in a detachable manner.

Further, the drum washing machine further includes a protective cover 13 for protecting the container 1, and the protective cover 13 is arranged in the mounting hole.

In the above solution, the protective cover 13 is arranged to protect the container 1, thereby preventing dust or liquid from entering the container 1 to pollute the washing additive, and also having a sealing effect of preventing leakage of the container 1.

Further, the shape of the protective cover 13 is matched with the shape of the mounting hole, and the shape of the container 1 is matched with the shape of the mounting hole.

In the above solution, the shape of the protective cover 13 is matched with the shape of the container 1, thereby better mounting the protective cover 13, and better playing a protection effect. The matching between the shape of the container 1 and the shape of the mounting hole enables the mounting to be simpler and more convenient, enables the setting to more compact, and avoids such problems as misplacement or delayed mounting.

Further, one end of the protective cover 13 is hinged with the mounting hole, and the other end is turned over movably around the hinged end to open or close the mounting hole.

In the above solution, the protective cover 13 can be clamped in the mounting hole, and can also be in threaded connection to the mounting hole, and in the present embodiment, the protective cover 13 is hinged to the mounting hole.

Further, the protective cover is provided with an uncovering part which is convenient to open the protective cover.

In the above solution, in order that the opening and closing of the machine door are not interfered, the protective cover 13 and the clothes delivery opening 12 are arranged on the same plane or are lower than the plane in which the clothes delivery opening 12 is located, at this time, the opening of the closed protective cover 13 becomes difficult, and the closed protective cover 13 is difficult to be opened directly with hands, and an elongate external object may be possibly needed to assist in opening the closed protective cover 13, thereby adding troublesome to the user. Therefore, in the present disclosure, an uncovering part 14 is arranged, to facilitate opening the protective cover 13, so as to take out the container 1 to add washing additive or directly supplement washing additive to the container 1.

Further, the mounting hole is arranged at the bottom of the clothes delivery opening 12, and the protective cover 13 is arranged above the mounting hole.

In the above solution, the space below the front panel 3 is sufficient, the mounting hole is formed at the bottom of the clothes delivery opening 12, and the container is arranged below the front panel 3 from the mounting hole.

Further, the container 1 is a box-shaped structure with at least the upper surface being rectangular, the surface, for setting the mounting hole, of the clothes delivery opening 12 is a plane, and the upper surface of the protective cover 13 is lower than or in parallel with the plane.

In the above solution, the upper surface of the protective cover 13 is lower than or in parallel with the plane in which the mounting hole is arranged, to produce no interference to the opening and closing of the machine door.

Further, the protective cover 13 is provided with an uncovering part 14 which is convenient to open the protective cover 13, preferably, the uncovering part 14 is a notch arranged on the protective cover 13 and convenient for being pulled by hands, more preferably, the notch is a notch arranged on another movable end of the protective cover 13.

Further, the mounting hole includes a limit part for limiting the mounting of the container 1.

In the above solution, a limit part is arranged to enable the taking out or placing of the container 1 to be simpler and more convenient, such problems as misplacement will not exist, thereby avoiding incapability in normal automatic delivery of the washing additive or incapability in normal detection of liquid level caused by such problems as misplacement.

Embodiment 4

Figure 7:
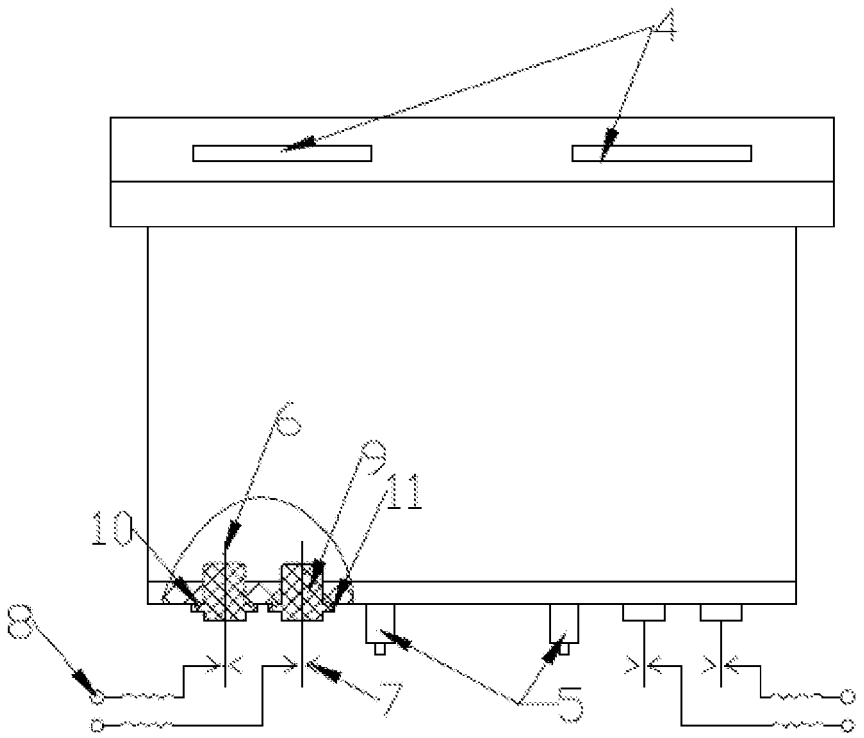
FIG. 7 is a partial sectional view of a container of the present disclosure.
Figure 8:
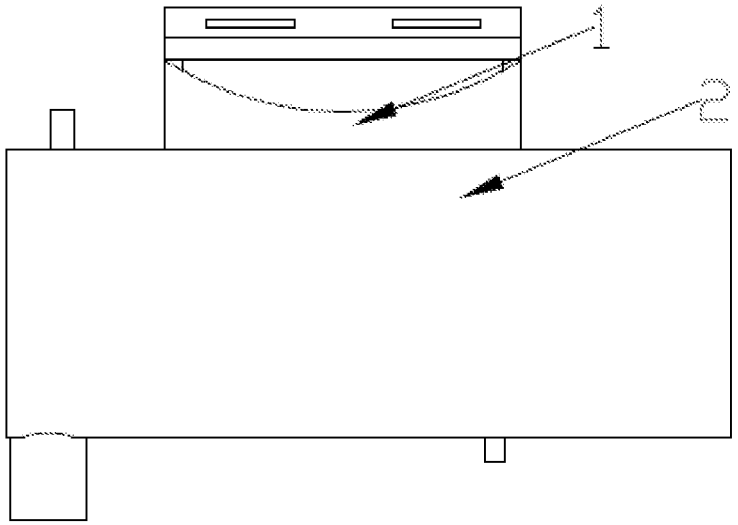
FIG. 8 is a schematic diagram of a washing additive automatic delivery device of the present disclosure.
Figure 9:
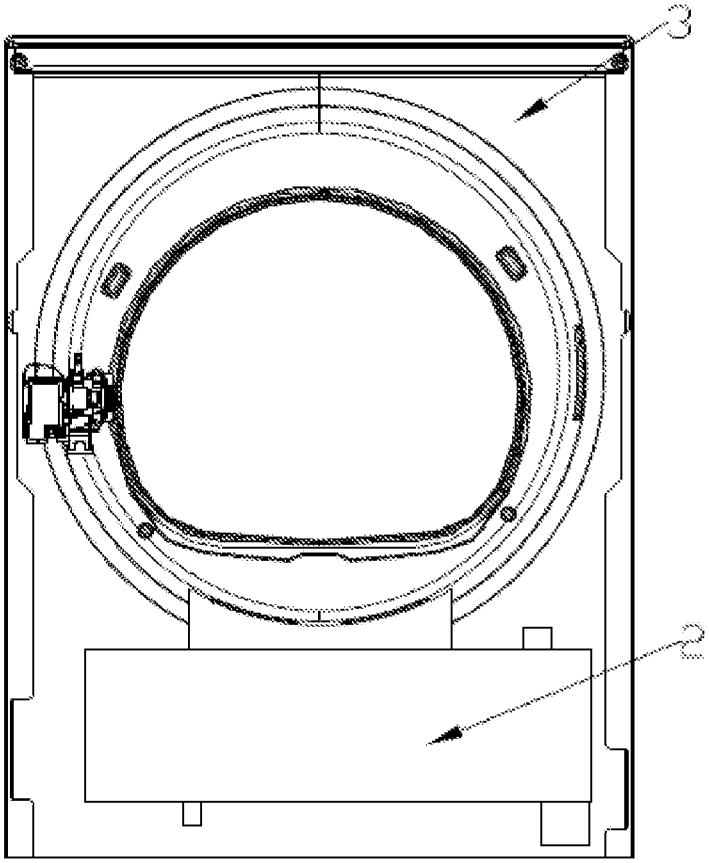
FIG. 9 is a schematic diagram of a mounting manner of a washing additive automatic delivery device of the present disclosure.

As shown in FIG. 7 to FIG. 9, in the present embodiment, the washing machine further includes at least one group of liquid level detection structures for detecting the liquid level inside the container 1.

In the above solution, since the container 1 is generally connected with various pipelines, the operation of taking out the container 1 to supplement liquid is very difficult, and a professional staff is required to operate, thereby bringing great inconvenience to the user in supplementing the washing additive. In the present disclosure, the container 1 is arranged in the mounting part 2 in a removable manner, thereby facilitating taking out the container 1 for such operations as liquid supplement and maintenance. As to the washing additive automatic delivery device, since washing additive is automatically delivered to the washing machine, and the user cannot see the amount of the washing additive in the container 1, therefore, liquid level reminding is especially required for the washing additive automatic delivery device, especially the lowest liquid level reminding. While for the ordinary washing additive automatic delivery device, real-time monitoring of the amount of the washing additive is not necessary, warning reminding is only needed when the liquid level of the washing additive is lower than the lowest liquid level and related processes are performed, thereby avoiding such problems of incomplete and unclean washing caused by insufficient washing additive. In the present disclosure, the container 1 is arranged in the mounting part 2 in a removable manner, to facilitate supplement of the washing additive; the liquid level detection structure is used for liquid level detection of the container 1 which is arranged in the mounting part 2 in a removable manner, after the container 1 is taken out to supplement the washing additive, after the container 1 is placed, sensitive and accurate liquid level detection can be performed continuously.

Further, the liquid level detection structure includes a detection part 6, and a conducting part 7 connected with the circuit, wherein one end of the detection part 6 is inserted into the container in a sealed manner, and the other end is in contact with the conducting part 7 to conduct the circuit when the container 1 is placed in the mounting part 2, and is separated from the conducting part 7 to disconnect the circuit when the container 1 is taken out from the mounting part 2.

In the above solution, the detection part 6 is configured to detect the liquid level, and the conducting part 7 is configured to conduct the circuit. Since the container 1 is arranged in the mounting part 2 in a removable manner, then when the container 1 is taken out, the detection part 6 is taken out together with the container 1, the detection part 6 departs from the conducting part 7, the circuit is disconnected, and liquid level cannot be detected; when the container 1 is placed in the container mounting part 2, the detection part 6 is in contact with the conducting part 7 again, the circuit is conducted, and liquid level is detected continuously.

Further, the liquid level detection structure includes two detection parts 6, when the washing additive in the container is in contact with both the two detection parts 6, the two detection parts 6 are conducted through the washing additive, the liquid level detection structure forms a circuit channel, and the detection part 6 detects that sufficient washing additive is available. Otherwise, if the washing additive in the container is not in contact with at least one of the two detection parts 6, the circuit between the two detection parts 6 is disconnected, then the liquid level is low and washing additive needs to be supplemented.

In the above solution, the two detection parts 6 are respectively electrically connected with the control module through the conducting part 7, when the two detection parts 6 are conducted, the whole signal circuit is communicated, then signals are transmitted, otherwise, the whole signal circuit is disconnected, and no signal is transmitted. Wherein the two detection parts 6 are conducted when the two detection parts 6 are both in contact with the washing additive in the detergent storage chamber, since the washing additive is conductive, when the two detection parts 6 are both in contact with the washing additive, the washing additive serves as a wire between the two detection parts 6 to communicate the two detection parts 6.

Further, the liquid level detection structure further includes a fixed part 9, the detection part 6 is wrapped in the fixed part 9 in a sealed manner, two ends are both arranged to extend out of the fixed part 9, one end of the detection part 6 is inserted into the container in a detachable manner through the fixed part 9, preferably, the fixed part 9 is connected with the container 1 through threads.

In the above solution, the fixed part 9 is made of insulating materials, and the fixed part 9 inserts the detection part 6 into the container. The fixed part 9 itself is not inserted, at this time, the fixed part 9 plays a role of sealing and fixing the detection part 6, such that the detection part 6 and the container 1 are more easily connected in a sealed manner.

Further, one end of the detection part 6 is inserted into the container in a sealed and detachable manner from the bottom of the container 1 through the fixed part 9, the fixed part 9 is made of insulating materials, at least part of the fixed part 9 is inserted into the container, and the height from the top of the inserted part to the bottom of the container is the measurable lowest liquid level.

In the above solution, the detection part 6 of the liquid level detection structure of the present disclosure is inserted into the container from the bottom of the container 1, thereby being convenient to detect whether washing additive in the container is sufficient or not, meanwhile, since the liquid outlet 5 is also arranged at the bottom, the arrangement in the bottom is convenient for mounting, does not increase other structures, and saves cost. In the present embodiment, the fixed part 9 is partially inserted into the container, at this time, the fixed part 9 not only plays a role of fixing the detection part 6 and enabling the detection part 6 to be easily connected with the container 1 in a sealed manner, but also plays a role of increasing the lowest liquid level. The fixed part 9 is made of insulating materials, thereby improving the height of the lowest liquid level, moreover, the lowest liquid level can be set according to requirements, thereby ensuring that sufficient washing additive is in the container when the liquid level is the lowest.

Further, if the liquid level of the washing additive in the container is higher than the fixed part 9, the two detection parts 6 are conducted, the liquid level detection structure forms a channel, the detection part detects that sufficient washing additive is available; otherwise, if the liquid level of the washing additive in the container is lower than the fixed part 9, the circuit between the two detection parts 6 is disconnected, then the liquid level is low and washing additive needs to be supplemented. In the above solution, since the fixed part 9 is insulated and is not conductive, so when the liquid level is below the fixed part 9, the detection part 6 is not in contact with the washing additive in the container 1, the two detection parts 6 cannot be conducted, only when the liquid level is above the fixed part 9, the detection part 6 is in contact with washing additive in the container 1 and is conducted.

Further, the liquid level detection structure further includes a sealing structure 10 for sealing the fixed part 9 and the container 1, the sealing structure 10 is arranged between the container 1 and the fixed part 9, preferably, the sealing part is a sealing ring.

In the above solution, the detection part 6 of the liquid level detection structure is inserted into the container 1 from the bottom, the container 1 is correspondingly provided with a detection hole, the washing additive easily flows out from the detection hole under the effect of gravity, the washing additive flowing out accidentally enters the washing drum to influence the precision of the automatic delivery amount, or the washing additive flowing out accidentally flows to the other substances inside the box of the washing machine to lead to waste and pollute or corrode other parts, therefore, the sealing at the detection hole is very important, and the setting of a sealing structure 10 to seal is imperative.

Further, the fixed part 9 includes a sealing boss 11 which is arranged to protrude out of the side wall, and the sealing structure 10 is arranged between the bottom of the container 1 and the sealing boss 11.

In the above solution, the fixed part 9 includes a sealing boss 11 which is arranged to protrude out of the side wall, the sealing boss 11 is ringwise and is arranged to protrude out of the side wall of the fixed part 9, thereby not only assisting in sealing but also playing a role of limiting the fixed part 9, and a sealing boss 11 is arranged to facilitate mounting.

Embodiment 5

The present embodiment further defines all the above embodiments, as shown in FIG. 7 to FIG. 9, the present embodiment discloses a washing machine, and the washing machine includes a washing additive automatic delivery device. The washing additive automatic delivery device includes a container 1 for accommodating the washing additive, and a mounting part 2 for holding the container, and the container 1 is arranged in the mounting part 2 in a removable manner.

The container 1 includes two liquid storage chambers, one liquid storage chamber accommodates detergent for washing clothes and is a detergent storage chamber, and the other liquid storage chamber accommodates softener and is a softener storage chamber. Each liquid storage chamber includes a liquid supplement opening 4 and a liquid outlet 5, the liquid outlet 5 is arranged at the bottom of the liquid storage chamber 1, the washing additive automatic delivery device further includes an automatic delivery structure, and the automatic delivery structure can automatically deliver the washing additive in the container 1 into the mounting part 2 from the liquid outlet 5 in a quantitative manner. The mounting part 2 is communicated with the washing drum, the mounting part 2 is provided with a water inlet and a water outlet, water entering from the water inlet scours the washing additive delivered by the container 1 into a washing drum, or the automatic delivery structure is communicated with a liquid outlet 5 and a washing drum, to automatically deliver the washing additive in the container 1 into the washing drum.

The washing additive automatic delivery device further includes two groups of liquid level detection structures, and each liquid storage chamber is provided with one group of liquid level detection structures. The liquid level detection structure includes a detection part 6, wherein the detection part 6 is a conducting probe, and an insulating fixed part 9, wherein the probe is wrapped between the fixed part 9, and the two ends of the probe respectively extend out of the fixed part 9. The liquid level detection structure further includes a conducting part 7, the conducting part 7 is a shrapnel structure communicated with a wiring terminal 8 through a signal line, and the other end of the detection part 6 is connected with the shrapnel structure in a pluggable manner. One end of the conducting probe and part of the fixed part 9 are inserted into the liquid storage chamber in a detachable and sealed manner, the height of the fixed part 9 inserting into the bottom of the liquid storage chamber is the lowest liquid level, the liquid level detection structure is configured to detect whether the washing additive in the liquid storage chamber is sufficient or not, and the other end of the conducting probe is inserted into the shrapnel structure, and is conducted with the circuit connected with the shrapnel structure.

Further, the washing additive automatic delivery device is arranged at the lower end of the front panel 3 of the washing machine, and is arranged below the clothes delivery opening, and the container 1 can be drawn out from the direction below the clothes delivery opening or can be inserted downwards into the mounting part.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. A washing additive automatic delivery device, comprising:

a container for accommodating washing additive;

a mounting part for holding the container, wherein the container is arranged in the mounting part in a removable manner; and at least one group of liquid level detection structures configured to detect liquid level in the container, the liquid level detection structures including a detection part, and a conducting part connected with a circuit, one end of the detection part is inserted into the container in a sealed manner, and another end of the detection part is in contact with the conducting part to conduct the circuit when the container is placed in the mounting part, and is separated from the conducting part to disconnect the circuit when the container is taken out from the mounting part.

2. The washing additive automatic delivery device according to claim 1, wherein the liquid level detection structures comprise two detection parts, when washing additive in the container is in contact with both the two detection parts, the two detection parts are conducted through the washing additive, the liquid level detection structures form a circuit pathway, and the detection part detects that sufficient washing additive is available; otherwise, when the washing additive in the container is not in contact with at least one of the two detection parts, the circuit between the two detection parts is disconnected, and the liquid level is low, the washing additive is needed to be supplemented.

3. The washing additive automatic delivery device according to claim 2, wherein the liquid level detection structures comprise a fixed part, the detection part is wrapped in the fixed part in a sealed manner, two ends of the detection part both extend out of the fixed part, one end of the detection part is inserted into the container in a detachable and sealed manner through the fixed part.

4. The washing additive automatic delivery device according to claim 3, wherein one end of the detection part is inserted into the container in a detachable and sealed manner from a bottom of the container through the fixed part, the fixed part is manufactured from insulating materials, at least a part of the fixed part is inserted into the container, and a height from a top end of the part of the fixed part to the bottom of the container is a measurable lowest liquid level.

5. The washing additive automatic delivery device according claim 3, wherein the liquid level detection structures comprise a sealing structure for sealing the fixed part and the container, and the sealing structure is arranged between the container and the fixed part.

6. The washing additive automatic delivery device according to claim 5, wherein the fixed part comprises a sealing protruding part which is arranged to protrude out of a side wall of the fixed part, and the sealing structure is arranged between the bottom of the container and the sealing protruding part.

7. The washing additive automatic delivery device according to claim 1, wherein the detection part is a conducting probe; the conducting part is a structure communicated with a wiring terminal through a signal line, and the other end of the detection part is connected with the structure in a pluggable manner.

8. The washing additive automatic delivery device according to claim 1, wherein the container comprises at least a liquid storage chamber configured to accommodate the washing additive, the liquid storage chamber includes at the least one group of the liquid level detection, the liquid level detection structures include the detection part and the conducting part connected with the circuit, one end of the detection part is inserted into the liquid storage chamber in a sealed manner, and the other end is in contact with the conducting part to conduct the circuit when the container is placed in the mounting part, and is separated from the conducting part to disconnect the circuit when the container is taken out from the mounting part, one end of the detection part is inserted into the liquid storage chamber in a detachable and sealed manner from the bottom of the container.

* * * * *